US005568021A

United States Patent [19]

Bederka et al.

[11] Patent Number: 5,568,021

[45] Date of Patent: Oct. 22, 1996

[54] ELECTROSTATIC ACCELERATOR UP TO 200 KV

[75] Inventors: Stefan Bederka, Bratislava; Reinhard Simon, Darmstadt, both of Germany

[73] Assignee: Gesellschaftfür Schwerionenforschung mbH, Darmsladt, Germany

[21] Appl. No.: 233,724

[22] Filed: Apr. 26, 1994

Related U.S. Application Data

[63] Continuation-in-part of Ser. No. 34,106, Mar. 22, 1993, abandoned.

[51] Int. Cl.[6] ..... H05H 7/00

[52] U.S. Cl. ..... 315/506; 313/360.1

[58] Field of Search ..... 315/506, 505; 363/59; 313/360.1

[56] References Cited

U.S. PATENT DOCUMENTS

| | | | |
|---|---|---|---|
| 2,215,155 | 9/1940 | Kallmann | 313/359.1 |
| 2,501,882 | 3/1950 | Trump et al. | 313/360.1 |
| 2,875,394 | 2/1959 | Cleland | 363/59 |
| 3,581,106 | 5/1971 | Peoples et al. | 307/150 |
| 3,602,827 | 8/1971 | Peoples | 315/506 |
| 3,723,846 | 3/1973 | Thompson, Jr. | 363/61 |
| 3,761,828 | 9/1973 | Pollard et al. | 315/505 |
| 3,793,550 | 2/1974 | Thompson, Jr. | 313/360.1 |
| 4,016,499 | 4/1977 | Bodker et al. | 315/506 |
| 4,309,747 | 1/1982 | Thompson | 363/61 |
| 4,814,716 | 3/1989 | Kato et al. | 315/111.81 |
| 5,021,741 | 6/1991 | Kornely, Jr. | 315/505 |
| 5,325,284 | 6/1994 | Stephenson | 363/59 |

*Primary Examiner*—Alvin E. Oberley
*Assistant Examiner*—Lawrence O. Richardson
*Attorney, Agent, or Firm*—Klaus J. Bach

[57] ABSTRACT

In an electrostatic accelerator with a target to be subjected to a beam of electrically charged particles in the energy range of 200 keV in a closed vacuum system, and an ion source for generation of the charged particles, a staged accelerator structure is disposed between the ion source and the target and includes a number of drift tubes disposed adjacent to one another in axially spaced but aligned relationship so as to permit passage of the beam therethrough and a high-voltage multiplier is disposed annularly around the drift tubes and is divided into stages corresponding to the adjacent drift tubes to which the stages are connected for providing accelerator voltages thereto thereby providing for a compact overall structure.

4 Claims, 4 Drawing Sheets

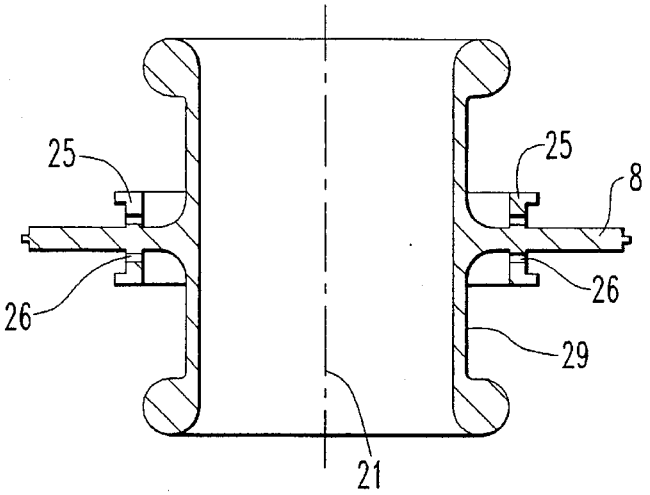
FIG. 2
FIG. 3
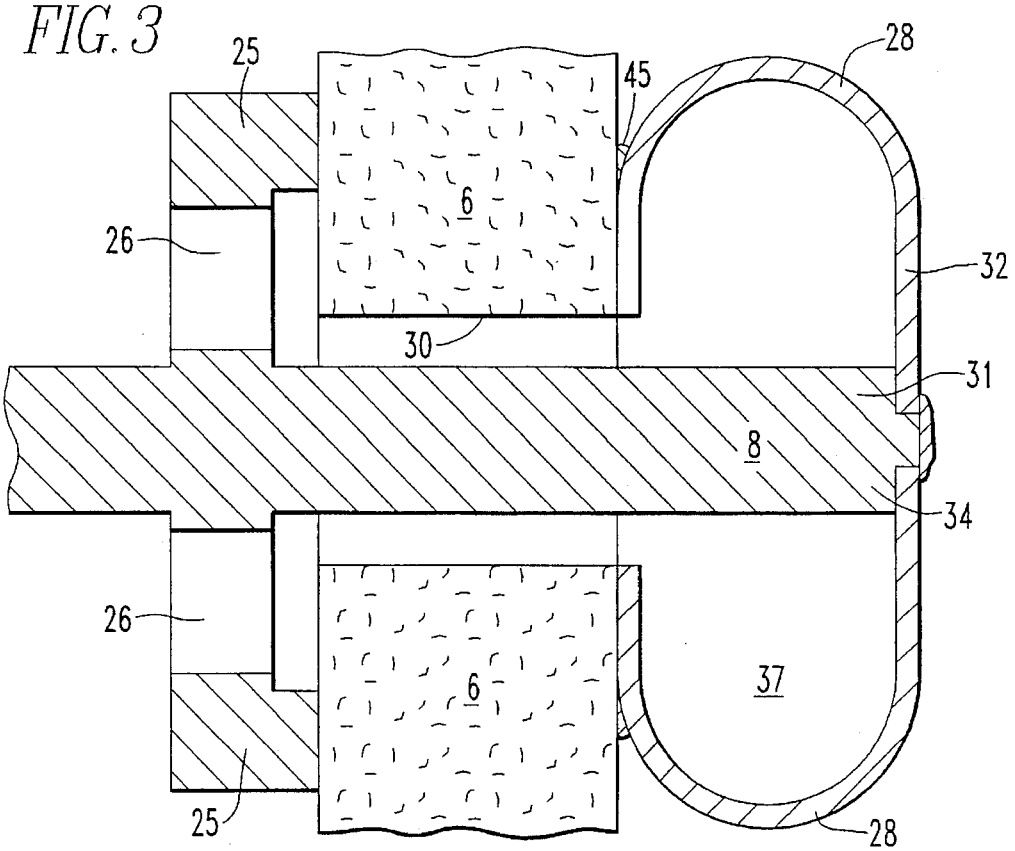

ELECTROSTATIC ACCELERATOR UP TO 200 KV

This application is a continuation-in-part application of patent application Ser. No. 08/034,106, which was filed on Mar. 22, 1993, now abandoned.

BACKGROUND OF THE INVENTION

The present invention relates to an electrostatic accelerator with a target onto which beams electrically charged particles are directed to generate gamma or neutron radiation of predetermined energies utilized for calibration measurements or in material research.

With such accelerator it is possible to generate, for example, particle beams of H+ or D+ ions with energies up to 200 keV and intensities of several mA. Such a particle beam is directed onto a predetermined target disposed at the end of an acceleration tube and generates, as a result of reactions with the cores of the target atoms, depending on the target material, a cascade of coincident, hard gamma radiation or neutrons of a high well-defined energy. The secondary radiation generated in this manner is suitable for calibration measurements or material testing, European Publication EP 0471 601 A2 discloses an accelerator of this type in which a CW-voltage multiplier (Cockroft/Walteron-multiplier) is arranged, when viewed in the direction of the radiation, behind the acceleration unit and even behind the target. Therefore, the voltage can be supplied to the acceleration unit axially only by means of tubular connections. This results in a certain disadvantage with regard to the manipulation of the apparatus for applications where the available space is limited or where the accelerator is not stationary.

It is the object of the present invention to provide an electrostatic accelerator which can be easily manipulated and transported and which is therefore compact and safe to operate and which therefore facilitates calibration measurements of radiation detectors and also material examination and irradiation to be performed at various locations.

SUMMARY OF THE INVENTION

In an electrostatic accelerator with a target to be subjected to a beam of electrically charged particles in the energy range of 200 keV in a closed vacuum system, and an ion source for generation of the charged particles, a staged accelerator structure is disposed between the ion source and the target and includes a number of drift tubes disposed adjacent to one another in axially spaced but aligned relationship so as to permit passage of the beam therethrough and a high-voltage multiplier is disposed annularly around the drift tubes and is divided into stages corresponding to the adjacent drift tubes to which the stages are connected for providing accelerator voltages thereto thereby providing for a compact overall structure.

In the accelerator according to the invention the coaxial arrangement of the accelerator tube and the voltage multiplier serving as high-voltage generator are essential for the compact structure. This is made possible by an arrangement wherein the drift tubes of the accelerator structure are constructed as a solid unit in a very special way by means of intermediate isolating ceramic tube sections. The operating voltages for the various drift tubes can then be supplied coaxially from the outside in a particularly advantageous manner. Because of short internal connections between the stages of the high-voltage multiplier and the respective accelerator stages there is no need for electric energy storage devices. Arrangement of the target at the end of the last accelerator stage insures safety of the apparatus with regard to insulative measures. Extraordinary peripheral safety measures around the apparatus during its operation are therefore superfluous.

Compactness and handling are further improved by the fact that the high-voltage multiplier is but It around a cylindrical support structure through which t he output of the stages are carried via high-voltage resistant penetrations. The cylindrical support structure together with the housing form, in an advantageous manner, the annular space in which the multiplier is received. Providing radial leads for the inputs of the voltage multiplier which extend through the base of the support structure permits direct connection of the high-voltage transformer with the leads. No high-voltage cables are needed therefore. As a result the whole arrangement is very compact and can be used as mobile units without peripheral safety measures.

BRIEF DESCRIPTION OF THE DRAWINGS

Details of the invention will be described below on the basis of FIGS. 1 to 3:

FIG. 2 shows the drift tube of the accelerator stages E2–E5;

FIG. 3 shows the interconnection of two adjacent accelerator stages.

DESCRIPTION OF THE PREFERRED EMBODIMENT

Figure 1:
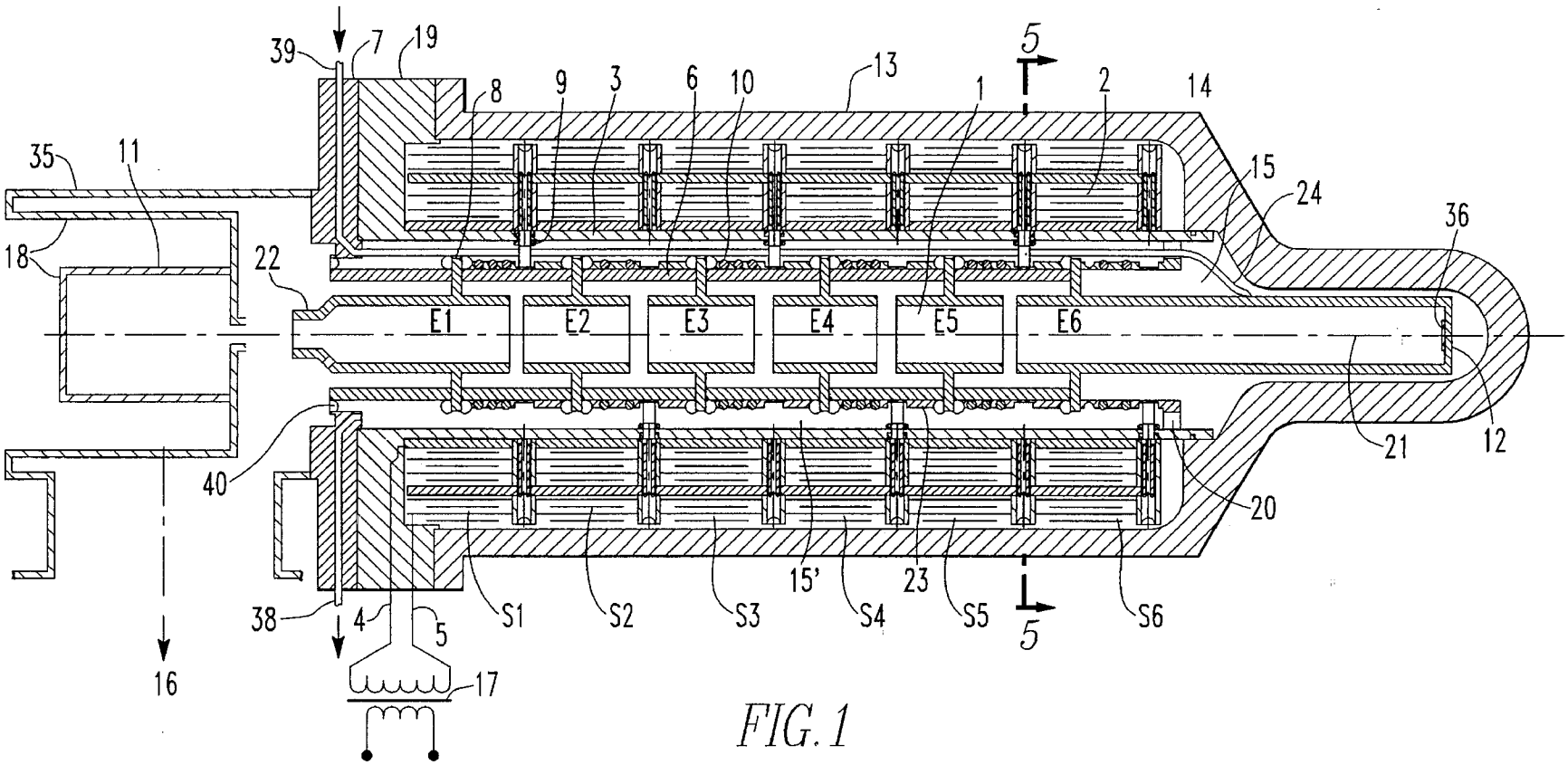
FIG. 1 is a cross-sectional view of the complete accelerator taken along the accelerator axis.

The electrostatic accelerator is shown schematically in FIG. 1. In it a target 12 is exposed to beams of electrically charged particles in the energy range of 200 keV in a closed vacuum system disposed essentially in a housing 13. The main components of the accelerator are a source 18 for the emission of charged particles, a step-up acceleration structure 1 extending from the source 18 and comprising tubular drift tubes E1–E6 which are arranged in axial alignment and spaced from one another through which the beam passes and which together form the passage of the accelerator structure 1, a high-voltage multiplier 2 for the accelerator voltage applied to the drift tubes E1–E6 and the already-mentioned target 12 which is disposed on a cooled carrier 36 arranged at the end of the acceleration passage.

A high-voltage multiplier 2 in the embodiment as shown in FIG. 1 consists of six identical stages S1–S6. However the number of stages is not limited to six. The number of stages and the corresponding number voltage steps depend on the desired application and may therefore be smaller or greater than given in the exemplary embodiment according to FIG. 1. The six stages S1–S6 of the generator, that is, of high-voltage multiplier 2, are disposed on the cylindrical portion of a carrier 3 of the multiplier 2 through which the outputs 9 of the stages S1–S6 extend via high-voltage resistant penetrations and which, together with the surrounding housing 13, define a closed annular cylindrical hollow space 14 in which the multiplier 2 is disposed. In the embodiment described, this space is filled with an insulating oil. The carrier 3 has a socket 19 on which a high-voltage transformer 17 is mounted and is connected directly to the multiplier 2 via internal conductors 4 and 5.

The acceleration tube 1 also comprises six stages corresponding to the stages S1–S6 of the generator. The drift tubes E1–E6 of the accelerator stages are aligned along the axis 21 of the accelerator. The gaps between adjacent drift tubes E1–E6 are acceleration gaps across which there is a potential difference which effective between every two adjacent multiplier stages S. Ion optically the acceleration gaps between the drift tubes E1–E6 are so selected that the ion beam is focused onto the target area.

Each drift tube includes a concentric disc disposed around the tube and in a plane normal to the accelerator axis 21 (see FIG. 2). These discs 8 serve on one hand as electrical contact structures and, for this purpose, are connected, by way of a resistor chain 10, to the exit of the respective stages S1–S6 of the high-voltage multiplier 2, each of the exits of the various stages S1–S6 of the high-voltage multiplier 2 being connected to the respective contact disc 8 of the respective associated drift tube E1–E6 via a resistor chain 10 surrounding the corresponding tube portion 6. On the other hand the discs serve as centering devices for the alignment of the drift tubes E1–E6 and, by means of the ceramic cylinder structure 6, they provide for the mechanical interconnection between the drift tubes E the respective adjacent accelerator stages or, respectively, the flange 7.

For this purpose the centering and contact discs 8 radially surrounding and extending from the side 29 of each of the drift tubes E1–E6 of the accelerator tube structure are in electrical contact with the respective drift tubes and are connected to the end faces 30 of the adjacent ceramic tube sections 6. For this purpose the contact discs 8 have an outer diameter so as to project radially beyond the tube sections 6 and the ends of the tube sections are sealed with these projection portions by means of a joint which will be described in detail below. In the arrangement shown, each drift tube E1–E6 together with its contact and centering disc consists of a single member of stainless steel or another metal.

As shown in FIG. 1 the acceleration structure 1 with all stages formed by the various drift tubes E1–E6 is arranged over its full length coaxially within the high-voltage multiplier S1–S6 which is equally staged and annularly surrounds the drift tubes. The various drift tubes E1–E6 are insulated and spaced from one another by means of the ceramic tube portions 6 which extend between the discs 8 and are interconnected with the tube portions so as to form a rigid tubular unit in a manner to be described in detail below.

The drift tube of the first acceleration stage E1 is provided, at its end adjacent the ion source 18, with a removable focusing electrode 22, whereas the drift tube of the last acceleration stage E6 terminates in a tube which is closed by a plate 36 serving as a carrier or the target 12 which is mounted on the inner side thereof.

The adjoining accelerator stages E1–E6 together form the accelerator tube 1. The space 15 within the housing 13 in which this accelerator structure 1 is contained is evacuated together with the ion source 18 via a pump connection 16 of the housing 35 of the ion source 18 which is mounted onto the accelerator structure.

FIG. 2 shows one of the drift tubes E2–ES, as used in the intermediate stages, with the contact and centering disc 8 attached thereto. A bearing ring 25 surrounding the tube portions at both sides of the contact and centering disc provides for concentricity of the ceramic tube portions 6 which abut the disc 8 at its opposite right and left sides with regard to the axis 21 of the accelerator and the drift tubes E1–ES. The bearing ring 25 which is spaced from the outer surface 29 of the tube includes radial bores 26 which extend parallel to, and directly adjacent, the outer surfaces of the disc 8.

FIG. 3 shows details of the connection between two ceramic tube portions 6 with the contact and centering disc 8 disposed therebetween (for example, at the right side of FIG. 2). The ceramic tube portions 6 carry at each end U-shaped metallic spring rings 28 which are curved toward the disc 8 and have legs of unequal length with the outer longer leg 32 being welded onto the outer wall 34 of the outwardly projecting portion 31 of the disc 8 and the shorter leg 33 being connected by a solder joint 45 to the outer edge of the respective tube portion 6 adjacent the front ace 30 thereof. Because of the unequal length of the legs 32 and 33, grooves 27 formed between the tube portions 6 and the disc 8 are bridged and covered by the spring rings 28. The U-shaped stainless steel ring 28 with legs of unequal length has its shorter leg soldered to the end of the ceramic cylinder 6 over the whole circumference thereof and that it is fully vacuum-sealed and the grooves 27 formed in the face of the tube 6 are not closed thereby. The outer longer leg 32 is welded to the contact and centering disc 8 during assembly in a vacuum-sealed manner. The grooves 27 and the bores 26 serve as air passages for the evacuation of the annular space 37. Assembly of the acceleration tube structure, that is, assembly of the drift tubes E1–E6 with the ceramic tube sections 6, is performed on a mandrel onto which the ceramic tube portions 6 and the drift tubes with their contact and centering discs 8 are alternately placed so as to be in alignment in which position they are then welded together.

The flange 7 is bolted to the housing 13 and maintains the high-voltage multiplier 2 and the acceleration tube structure 1 formed by the drift tubes E1–E6 in their predetermined concentric positions by means of the insulating spacing member 40. The ion source 18 is also directly mounted on the flange 7. The plasma chamber 11 and the acceleration tube structure 1 with target 12 are aligned along a common axis 21.

Between the high-voltage multiplier 2 and the acceleration tube structure 1 there is a hollow space 15 which, at the low energy end adjacent the ion source, is bordered by the support flange 7 and, at the high energy end, is delineated by the housing 13.

In the area of the last stage, the drift tube E6 and, together therewith, the whole unit is supported on the interior wall of the carrier 3 by means of a cylindrical insulation member 20 which also receives the resistor chain 10 leading to the drift tube E6. The resistor chains 10 for the drift tubes E1–E6 are supported by semisleeves 23 which, between the contact and centering discs 8, are disposed around the ceramic tube sections 6. For the supply of current to the contact discs 8 the resistor chains 10 are in contact with the curved portions of the U-shaped spring rings 28.

A hose or pipe 24 extends through the space 15 from an inlet passage 39 in the flange 7 through the accelerator toward the target 12 so that a coolant, such as insulating oil, conducted through the hose is directed thereby to flow around the end portion of the acceleration tube structure 1 for cooling of the target support 36 from the outside. The return flow of the coolant passes through the hollow space 15 and exits through a discharge passage 38 in the flange 7.

In addition to forming an extremely compact structure it is an advantageous aspect of the accelerator according to the invention that the interior space 15 of the accelerator is easily accessible from the ion source 18: Upon removal of the plasma chamber 11 and of the focusing electrode 22 the target 12 at the distal end of the last drift tube E6 can easily be replaced without further disassembly of the accelerator. With all the design features described above and as a result of the coaxial arrangement of the components, the outer diameter of the high-voltage multiplier, that is, the diameter the hollow space 14, can be made to be in the area of only 200 mm.

Figure 4:
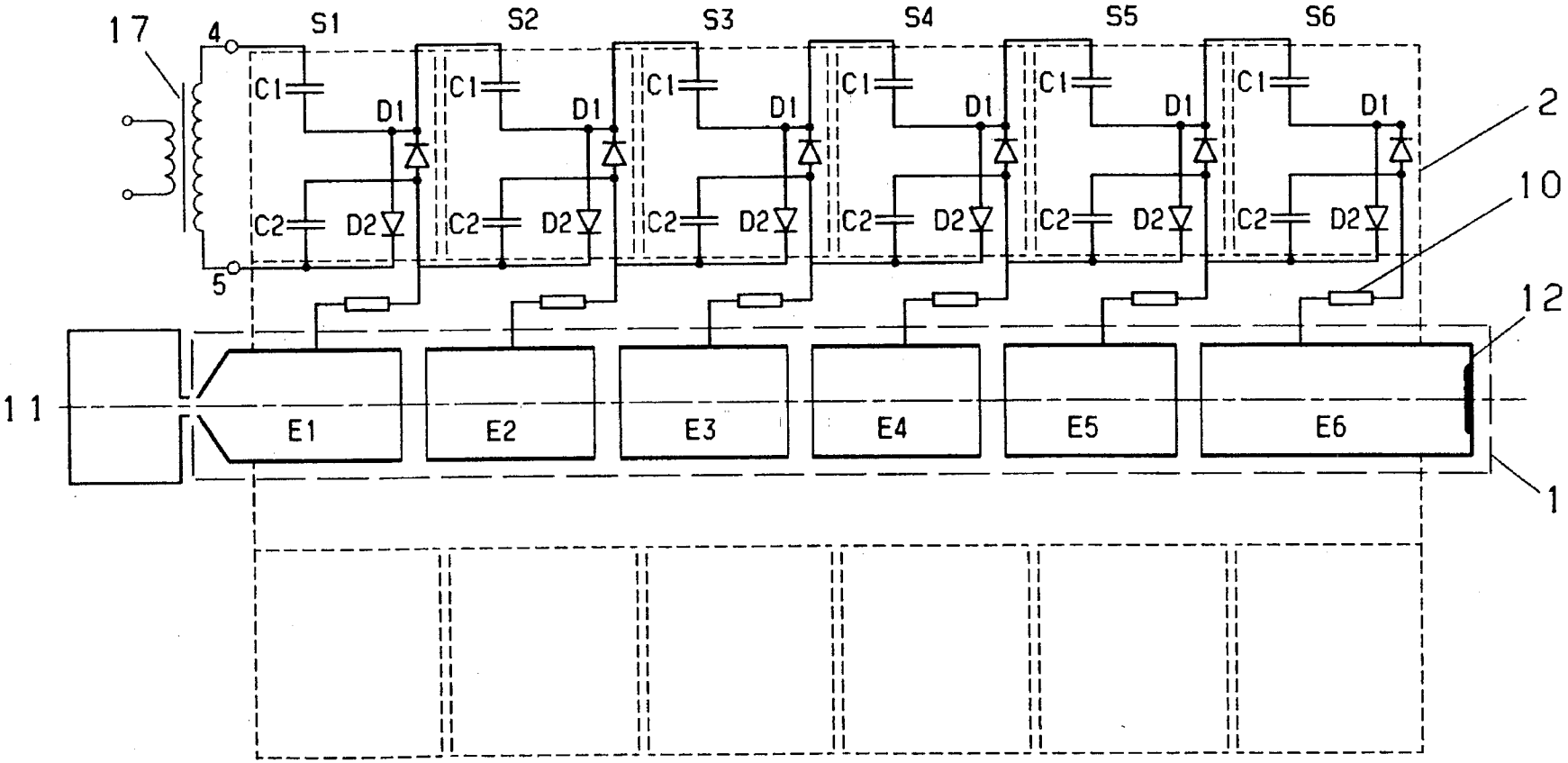
FIG. 4 shows the electric circuitry for the high voltage multiplier and the high voltage supply for the accelerator stages.

FIG. 4 shows an electric circuit diagram for the compact accelerator according to the invention. The exit of the high voltage multiplier stages S1–S6 are connected to the corresponding accelerator stages E1–E6 via the respective resistor structure 10. Each high voltage stage S1–S6 comprises a capacitor C1 with a corresponding diode D2 for the buildup of the potential by the positive half wave of the high voltage transformer 17 and a capacitor C2 with a corresponding diode D1 for the potential buildup by the negative half wave.

Figure 5:
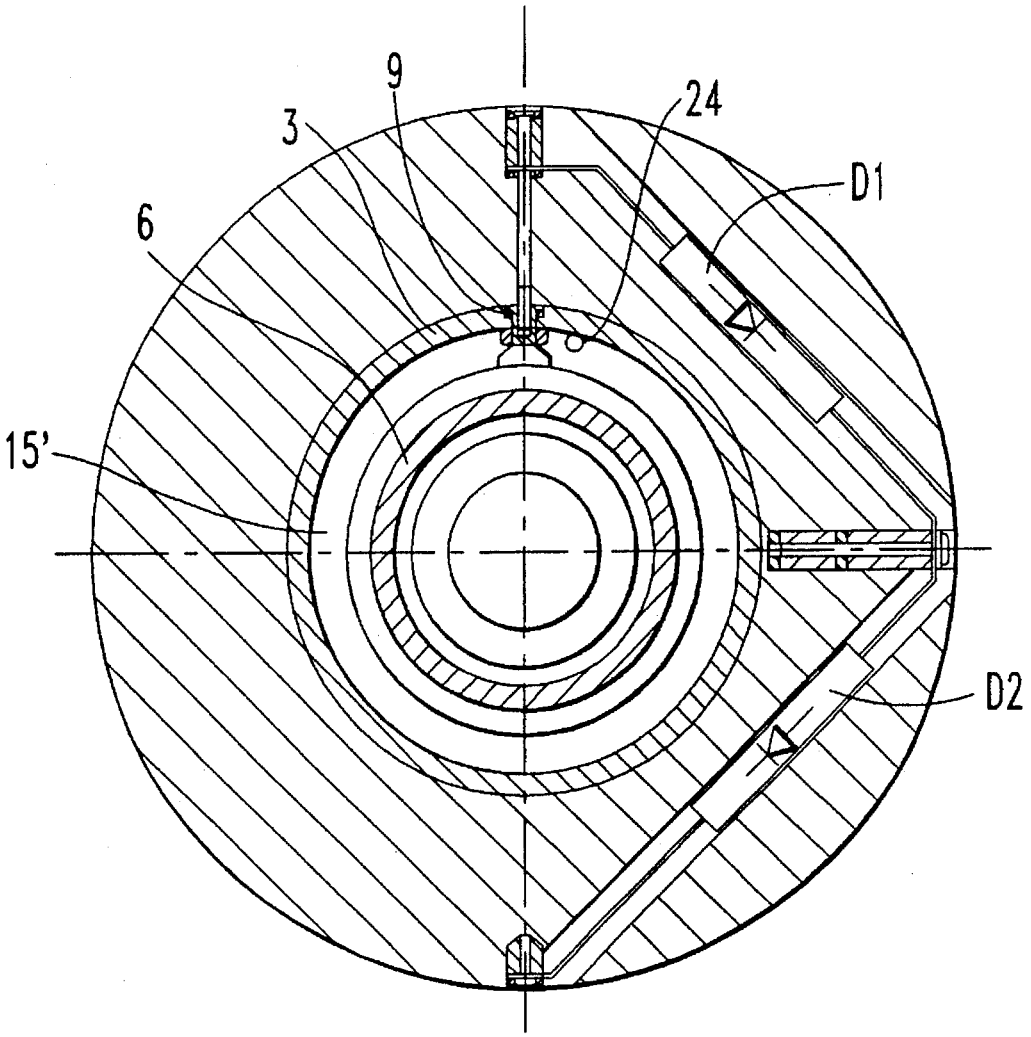

FIG. 5 is a cross-sectional view taken along line 5—5 of FIG. 1, the diodes D1, D2 and the multiplier stage exit 9 extending through the multiplier carrier 3 to the resister chain structure 10 which is mounted on the ceramic tube portion 6. The coolant supply hose 24 extends through the annular passage 15' between the carrier 3 and the ceramic tube portion 6 to supply coolant to the target 12, the coolant returning to the discharge passage 38 through the annular passage 15'.

LISTING OF REFERENCE NUMERALS

| | |
|---|---|
| 1 | Acceleration structure |
| 2 | High-voltage multiplier |
| 3 | Multiplier carrier |
| 4 | Conductor |
| 5 | Conductor |
| 6 | Ceramic tube portion |
| 7 | Flange |
| 8 | Contact and centering disc |
| 9 | Multiplier stage exit |
| 10 | Resistor chain |
| 11 | Plasma chamber |
| 12 | Target |
| 13 | Housing |
| 14 | Hollow space |
| 15 | Hollow space |
| 16 | Pump connection |
| 17 | High-voltage transformer |
| 18 | Ion source |
| 19 | Socket |
| 20 | Insulation member |
| 21 | Acceleration axis |
| 22 | Focusing electrode |
| 23 | Semisleeve |
| 24 | Hose |
| 25 | Bearing ring |
| 26 | Bores |
| 27 | Grooves |
| 28 | Stainless steel spring ring |
| 29 | Outer surface |
| 30 | Face |
| 31 | Projection |
| 32 | Longer leg of U-shaped spring ring |
| 33 | Shorter leg of U-shaped spring ring |
| 34 | Outer Wall |
| 35 | Ion source housing |
| 36 | Target carrier |
| 37 | Annular space |
| 38 | Discharge passage |
| 39 | Inlet passage |
| 40 | Insulating spacing member |
| E1–E6 | Drift tubes of the accelerator stages |
| S1–S6 | High-voltage multiplier stages |

What is claimed is:

1. An electrostatic acclerator for generating a particle beam of elecrically charged particles in the energy range of 200 keV and directing it onto a target within a closed vacuum system, comprising the following features:

a) an ion source for the generation of a beam of charged particles, b) a staged accelerators structure arranged adjacent said ion source and including a number of drift tubes disposed adjacent to one another in axially aligned spaced relationship so as to permit passage of said beam therethrough, said drift tubes being insulated and spaced from one another by means of ceramic tube portions arranged one after the other in serial alignment and connected to said drift tubes so as to form, together, a tubular unitary structure, each of said drift tubes of the accelerator structure being provided with a radially projecting circumferential contact and centering disc having opposite sides to which the ends of the adjacent ceramic tube-portions are mounted, said contact and centering discs projecting radially beyond said ceramic tube portions and being sealing connected thereto by a U-shaped metallic spring ring which is open toward said disc and which has legs of unequal length, with the outer, longer legs being welded onto the circumferential edge of the radially projecting disc portions and the inner, shorter legs being soldered to the outside of the adjacent tube portions next to the end faces thereof, c) a high voltage multiplier for providing accelerator voltages applied to said drift tubes, d) a target disposed on a cooled carrier arranged at the end of said accelerator structure opposite said ion source, and e) said accelerator structure with said drift tubes being arranged coaxially within the high voltage multiplier and said high voltage multiplier being annular and extending over the whole length of the accelerator structure and also being divided into stages which are arranged adjacent the corresponding drift tubes to which they are connected for providing thereto said accelerator voltages.

2. An electrostatic accelerator according to claim 1, wherein said spring rings are connected with their legs of unequal length to said discs and said tube portion in such a manner that spacing grooves formed between the tube sections and the discs are bridged and closed up by said spring rings.

3. An electrostatic accelerator according to claim 1, wherein the various stages of the high-voltage multiplier have exits connected to the contact discs to the respective associated drift tubes by means of high-voltage resistant penetrations and resistor chains disposed around the respective ceramic tube portions.

4. An electrostatic accelerator according to claim 3, wherein, for supplying current to the contact discs, the resistor chains are in contact with the curved areas of the U-shaped spring rings.

* * * * *